US006382462B1

(12) United States Patent
Ostergaard-Nielsen et al.

(10) Patent No.: US 6,382,462 B1
(45) Date of Patent: May 7, 2002

(54) PACKAGING

(75) Inventors: Mogens Ostergaard-Nielsen, Risskov (DK); Nigel David Harrison, Cambridge (GB); Steen Markfoged Petersen, Risskov (DK)

(73) Assignee: Elopak A.S., Lierstranda (NO)

( * ) Notice: Subject to any disclaimer, the term of this patent is extended or adjusted under 35 U.S.C. 154(b) by 0 days.

(21) Appl. No.: 09/622,493

(22) PCT Filed: Feb. 17, 1999

(86) PCT No.: PCT/GB99/00326

§ 371 Date: Nov. 15, 2000

§ 102(e) Date: Nov. 15, 2000

(87) PCT Pub. No.: WO99/42375

PCT Pub. Date: Aug. 26, 1999

(30) Foreign Application Priority Data

Feb. 17, 1998 (DK) ..... 0223/98

(51) Int. Cl.[7] ..... B65D 47/10

(52) U.S. Cl. ..... 222/1; 222/541.2; 222/541.6; 222/83

(58) Field of Search ..... 222/107, 83, 83.5, 222/541.2, 541.6, 88, 89, 90, 1, 81; 383/200

(56) References Cited

U.S. PATENT DOCUMENTS 4,813,578 A * 3/1989 Gordon ..... 222/541
4,948,015 A * 8/1990 Kawajiri et al. ..... 222/107
5,020,690 A * 6/1991 Kishikawa et al. ..... 222/83
5,141,133 A * 8/1992 Ninomiya et al. ..... 222/83
5,228,592 A * 7/1993 Pellerano ..... 222/83
5,297,696 A * 3/1994 Bernstein et al. ..... 222/83
5,366,114 A * 11/1994 Bernstein et al. ..... 222/83
5,482,176 A * 1/1996 Maietta et al. ..... 222/80
5,851,608 A * 12/1998 Yamada et al. ..... 222/80
5,947,318 A * 9/1999 Palm ..... 222/83

FOREIGN PATENT DOCUMENTS

EP WO-96/11850 * 4/1996 ..... B65D/5/74

* cited by examiner

*Primary Examiner*—Joseph A. Kaufman
*Assistant Examiner*—Stephanie L. Willatt
(74) *Attorney, Agent, or Firm*—Reising, Ethington, Barnes, Kisselle, Learman and McCulloch, P.C.

(57) ABSTRACT

A plastics pour spout fitment (3) has not only a pour spour (4) thereof welded to plastics-coated paperboard packaging material (2), but also has a plunger (14) welded to a disc (8) of the material (2), the disc (8) being defined by a ring of weakening (6) in the material. Following purely linearly axially inward displacement of the plunger (14) relative to the pour spout (4), preferably followed by rotation of the plunger (14) about the axis A of the fitment (3) relative to the spout (4), to detach the disc (8) from the remainder of the material (2), the plunger (14), and thus the disc (8), are removed from the pour spout (4) as a screw cap (12) is removed from the spout (4).

36 Claims, 5 Drawing Sheets

PACKAGING

Figure 1:
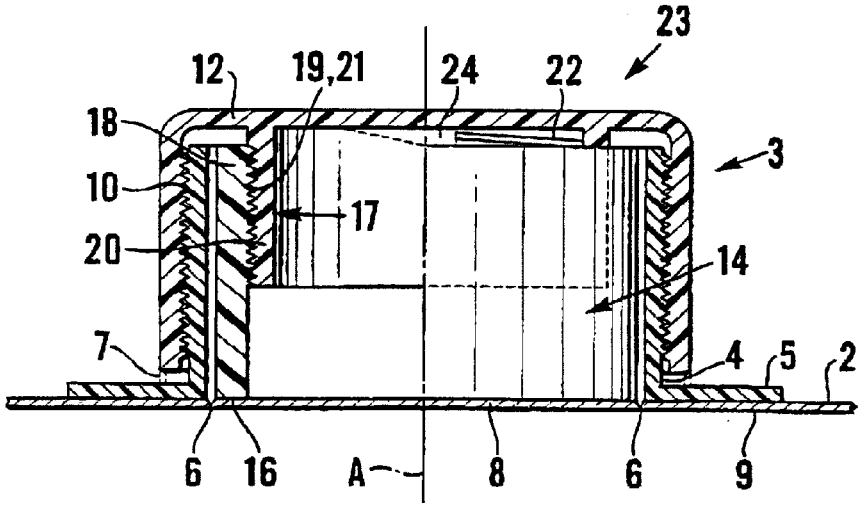

This invention relates to a pour spout fitment, a method in which the pour spout fitment is attached to packaging material, a combination of the pour spout fitment and the packaging material, and a method of opening the same.

A wide variety of pour spout fitments for packaging cartons are known.

Some of these known fitments include pour spouts which are inserted on the insides of the cartons through holes formed through panels of the cartons, so that pouring rims of the pour spouts project outwardly through the holes and flanges of the pour spouts are sealingly attached to portions of the inside surfaces of the carton panels round the peripheries of the holes. Such pour spout fitments can instead be inserted through, and sealed round, holes through carton blanks from which the cartons will be formed, for example on a form-fill-seal packaging machine. Generally, these types of pour spout fitments are attached before the cartons are filled.

Other known pour spout fitments are applied to the outsides of the carton blanks or cartons, around pouring holes formed through the panels. It is known to attach these types of pour spout fitments to the cartons either before filling or after filling.

It is conventional for pour spout fitments to be attached to packaging material in the form of a laminate consisting of paperboard coated on both faces with thermoplastics, particularly low density polyethylene (LDPE). It is also conventional for the packaging material to include, to the inside of the paperboard, a gas barrier layer, such as aluminium foil or ethylene vinyl alcohol (EVOH).

It is also known, with those types of pour spout fitments which are attached to the outsides of the packaging material, for the pour spouts not to encircle holes but to encircle barrier-forming discs of material, which may be that of the carton walls themselves or pieces of barrier film or foil closing the holes in the carton walls. The discs of material of the carton walls may be bounded by partial-depth cuts in an attempt to ensure that the carton opens more easily.

The pour spouts of the fitments are externally closed by screw caps, flip-tops, or flaps.

U.S. Pat. No. 4,813,578 discloses a plastics pour spout construction particularly adapted for longer shelf-life barrier paperboard containers, such as containers of the gable-top type, the interior surfaces of the containers being lined with a major barrier layer. A dispensing opening is formed through the paperboard and the major barrier layer extends across and covers this opening. An externally threaded pour spout, sealed to a polyethylene minor barrier layer of the container, carries a screw cap which normally closes the pour spout. This cap has integral therewith an inner annular skirt the lower edge of which is adhered to that portion of the minor barrier layer which spans the dispensing opening. When the cap is unscrewed from the spout, the skirt carries part of the overall barrier away from its normal position closing the opening, thus rupturing the overall barrier and permitting dispensing of the contents of the container. The dispensing opening is usually die-cut prior to extrusion of the minor barrier layer of LDPE onto the exterior surface of the paperboard and prior to the placement on the internal surface of the paperboard of the major barrier layer, which may be a single layer of, for example, "SURLYN", a metallic foil, polyethylene, or other material. Alternatively, the major barrier may be in the form of layers of two or more difference materials. The inner end of the skirt is adhered to the external surface of the LDPE layer in the dispensing opening by means of heat and pressure. The pour spout fitment relies upon strong adhesion between the skirt and the LDPE layer and between the LDPE layer and the major barrier layer for opening of the dispensing opening upon unscrewing of the cap. Rupture of the overall barrier is effected not only by axially outward movement of the skirt, but also by the rotation of the skirt relative to the pour spout and the container upon the initial unscrewing of the screw cap. Re-closing of the container, in the event that all of the contents have not been dispensed upon the initial opening, is effected by simply screwing the cap back on, although the barrier properties of the container are lost owing to the rupture of the overall barrier. The force required to rupture the overall barrier indicates to the consumer that the package has not been tampered with. In addition, the ruptured state of the overall barrier lends visual proof of tampering. Although it is preferred that the pour spout fitment should be applied to a container having an external layer of polyethylene, that layer may be omitted and some other adhesive then take the place of that layer for joining the major barrier to the inner edge of the skirt and for joining the pour spout to the paperboard wall. The screw cap may have its outer skirt omitted and, instead, interengaging screw threads be located between the inner skirt and the pour spout.

EP-B-0328652 discloses a plastics pour spout fitment in which a pour spout either extends through a hole through a carton wall and has its flange sealed to the inside of the wall, or has its flange sealed to the outside of the wall around a pouring port sealed with a film. In the former case, the inner end of the pour spout is sealed with a film. Within the pour spout is a tubular plunger formed at its inner end with a ring of downwardly projecting teeth which are interrupted at two diametrically opposite locations. Various embodiments of the fitment are disclosed. In certain embodiments, the plunger has two camming faces arranged at an angular pitch of 180° and extending outwardly to the outer end of the plunger. The two camming faces co-operate with respective downwardly-directed camming faces formed around the outside of an inner skirt of a screw cap arranged to be screwed onto the pour spout. Ratchet teeth formed on the inner peripheral surface of the pour spout co-operate with ratchet teeth formed on the outer peripheral surface of the plunger so as to produce rotation of the plunger with the screw cap during screwing of the screw cap onto the pour spout, but so as to prevent rotation of the plunger with the screw cap upon unscrewing of the latter. With the pour spout fitment sealed to the carton, unscrewing of the cap causes the plunger to displace axially inwards so that the teeth thereon pierce and break the film. Continued outward displacement of the cap opens the pour spout, leaving the plunger in its innermost position. Since the plunger remains in the pour spout, it reduces the through-flow cross-sectional area thereof.

U.S. Pat. No. 5,147,070 discloses a pour spout fitment in which a screw cap is removed and then, with a fingertip, a consumer pushes inwards a plunger formed at its inner end with a ring of teeth. Again, the plunger remains in the pour spout opening during pouring and thus restricts the through-flow cross-section thereof and, moreover, the use of a finger is unhygienic. U.S. Pat. No. 4,483,464 discloses a plastics, similar pour spout fitment.

GB-A-2210359 discloses a plastics pour spout fitment for a carton the wall structure of which includes a gas barrier layer. A gas barrier film is provided across the inner end of a pour spout of the fitment, and the gas barrier layer and the gas barrier film are overlapped or continuous when viewed axially of the fitment, to maintain gas barrier properties for the carton. In one version, the pour spout is connected via integral bridges to a disc integral with a ringpull inside the pour spout and adhered to the gas barrier film, the intention being that outward pulling of the ringpull breaks the disc away from the pour spout and thus breaks away from the remainder of the gas barrier film the part thereof adhered to the disc. The breaking-away of the relevant part of the film relies upon strong adhesion between the disc and film. Moreover, opening of the pour spout requires at least a finger to be inserted into the spout to engage the ringpull. In another version, unscrewing of a screw cap upon the pour spout causes an externally threaded inner skirt of the cap to screw downwards a tubular plunger formed with a ring of teeth at its inner end and guided by keys in longitudinal slots in the inner peripheral surface of the pour spout. Again, the plunger remains in the pour spout after opening and so constricts the through-flow cross-sectional area thereof.

U.S. Pat. No. 5,141,133 discloses a plurality of differing versions of pour spout fitment, in one of which an axially guided tubular plunger formed with a ring of teeth at its inner end breaks through a synthetic resin film closing a pouring opening through a paperboard wall, and in another version of which a blade at the inner end of a tubular plunger breaks away and pushes aside a disc defined by an annular score in the external surface of a container wall consisting of a paper layer with synthetic resin films laminated to respective opposite sides of the paper layer. In both of these versions, the plunger remains in its innermost position in the pour spout after opening.

EP-A-0385603 discloses a pour spout fitment in which a roof panel of a gable-top carton formed from a paper layer provided on respective opposite surfaces with thermoplastic resin layers has a slot of open-loop form punched therethrough, leaving a non-punched portion at the top of the loop. A barrier film, such as aluminium foil, is attached at the inner surface of the panel so as to cover the slot. A pour spout of a pour spout fitment is sealed to the outer surface of the panel around the slot and has connected integrally therewith via frangible bridges a tubular plunger formed at its inner end with teeth. The pour spout is closed by a screw cap. To open the carton, the screw cap is removed and the plunger pressed inwards by a consumer so that the ring of teeth enter the slot and break through the barrier film, causing the panel disc within the slot to turn inwards about the non-punched portion.

According to one aspect of the present invention, there is provided a pour spout fitment, comprising a pour spout having a longitudinal axis and adapted to be attached to packaging material, and a plunger in said pour spout and displaceable inwards along said axis relative to said pour spout to displace inwards a portion of said packaging material closing an inner end of the pour spout, characterized in that, following the inward displacement of the plunger, the plunger is displaceable outwards along said axis relative to said pour spout to beyond said pour spout and in that an inner end of said plunger is adapted to be attached to said portion of said packaging material, whereby the outward displacement of said plunger to beyond said pour spout would be accompanied by outward displacement of said portion to beyond said pour spout.

According to another aspect of the present invention, there is provided in combination, packaging material, and a pour spout fitment, comprising a pour spout having a longitudinal axis and attached to said packaging material, and a plunger in said pour spout and displaceable inwards along said axis relative to said pour spout to displace inwards a portion of said packaging material closing an inner end of the pour spout, characterized in that, following the inward displacement of the plunger, the plunger is displaceable outwards along said axis relative to said pour spout to beyond said pour spout and in that an inner end of said plunger is attached to said portion of said packaging material, whereby the outward displacement of said plunger to beyond said pour spout is accompanied by outward displacement of said portion to beyond said pour spout.

According to a third aspect of the present invention, there is provided a method comprising attaching to packaging material a pour spout of a pour spout fitment so that said pour spout extends round a portion of said material, said pour spout having a longitudinal axis, characterized by, prior to said attaching, forming a ring of weakness round said portion, and attaching to the outer surface of said portion a plunger of said pour spout fitment.

According to a fourth aspect of the present invention, there is provided a method comprising providing packaging material to which is attached a pour spout fitment, with a plunger of said fitment being attached to a portion of said material and a pour spout of said fitment being attached to portions of said material around said portion, detaching said portion from said portions by a procedure comprised of displacing said plunger inwardly along an axis of said fitment to cause said plunger to press against said portion, and withdrawing said plunger and thus said portion outwardly from said pour spout.

Owing to the present invention, it is possible to open a pouring opening in packaging material with a reasonably high degree of certainty, with complete removal of the packaging material part previously closing the opening, so that that part does not thereafter obstruct pouring, and with the plunger being removed so as not to obstruct the pour spout or the pouring opening.

Figure 2:
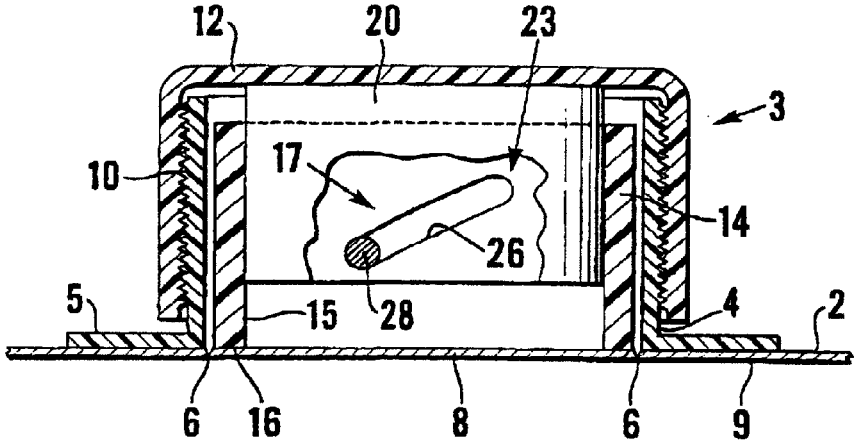
Figure 3:
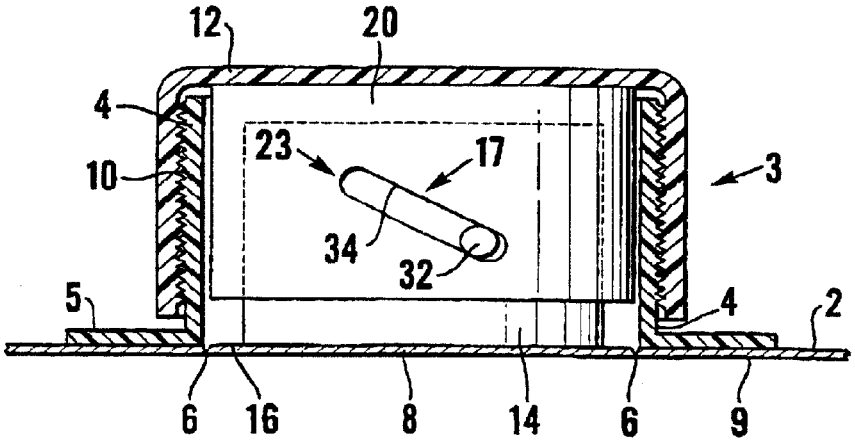
Figure 4:
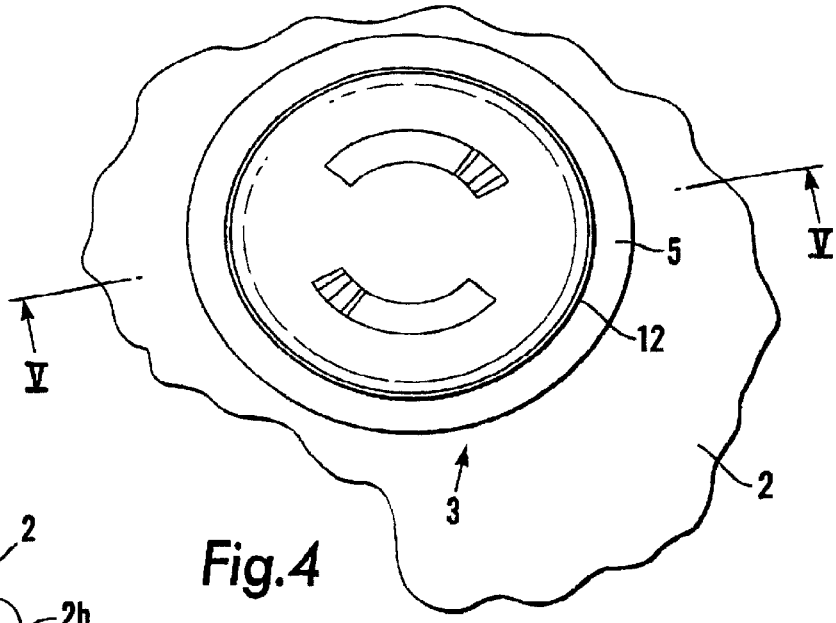
Figure 7:
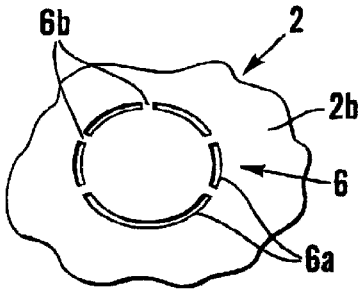
Figure 5:
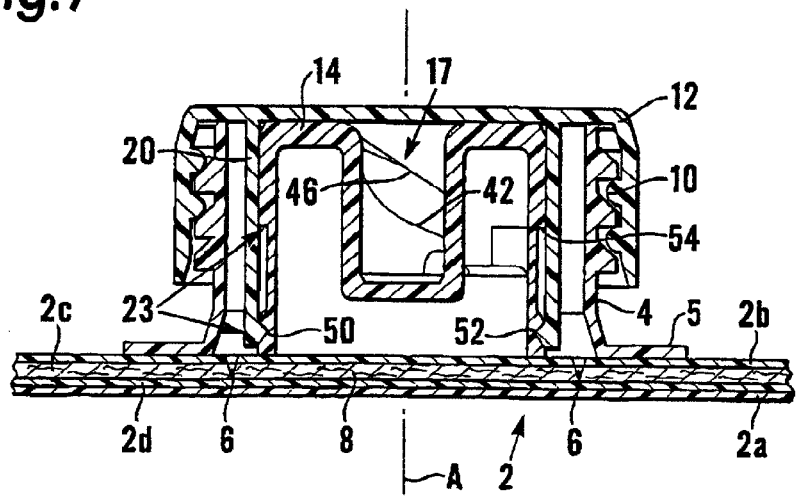
Figure 6:
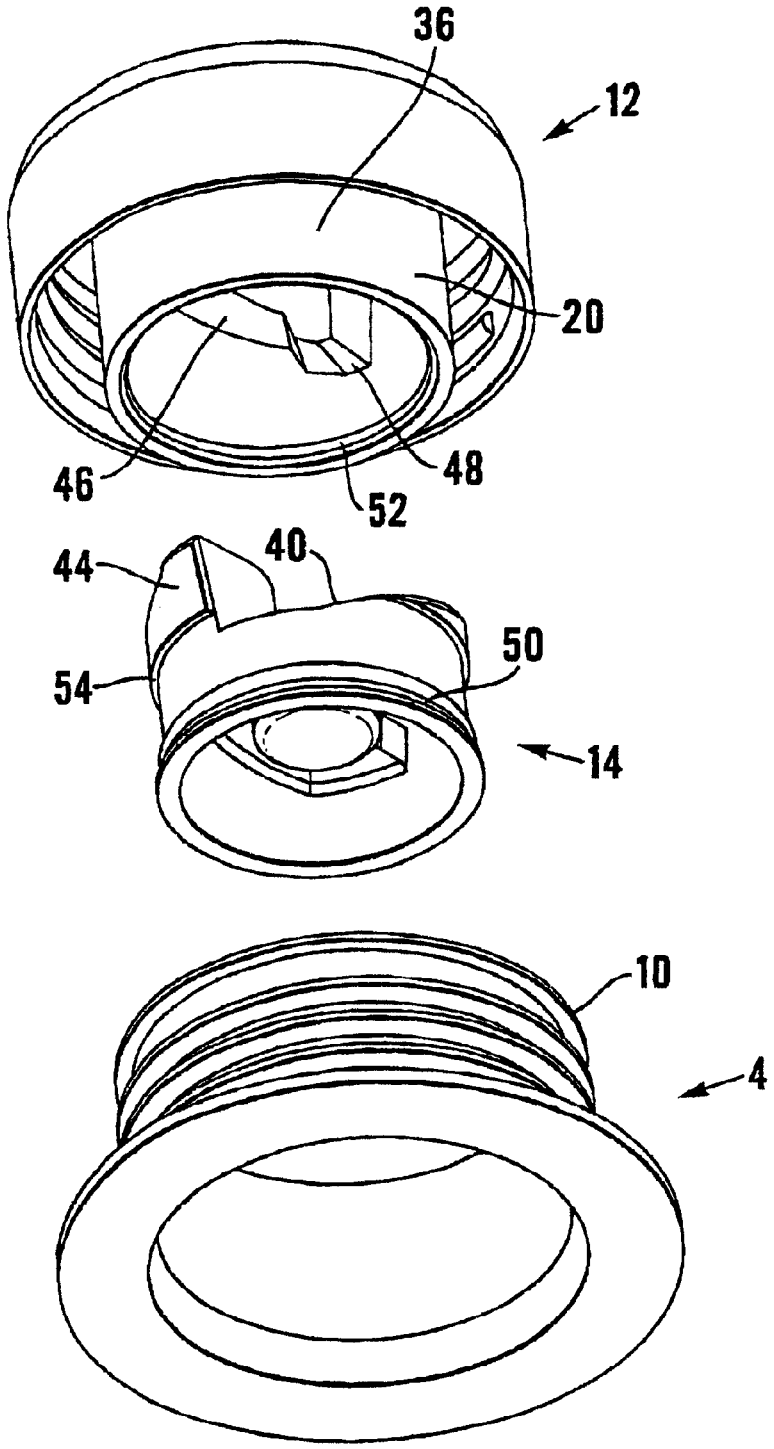
Figure 8:
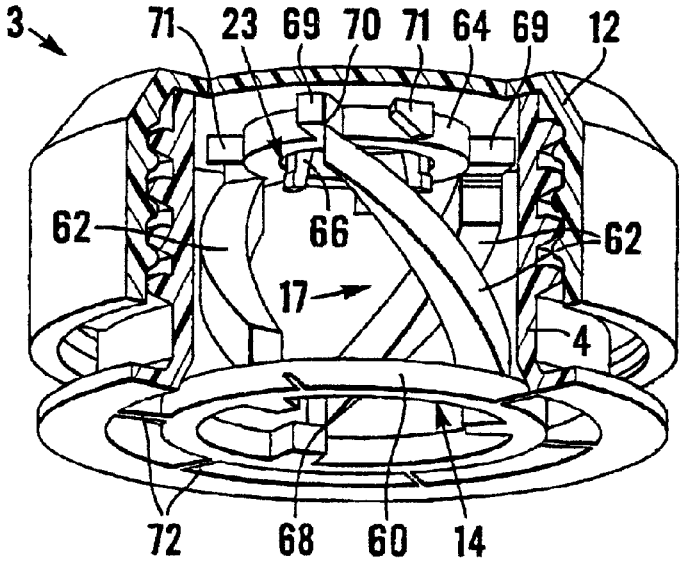
Figure 10:
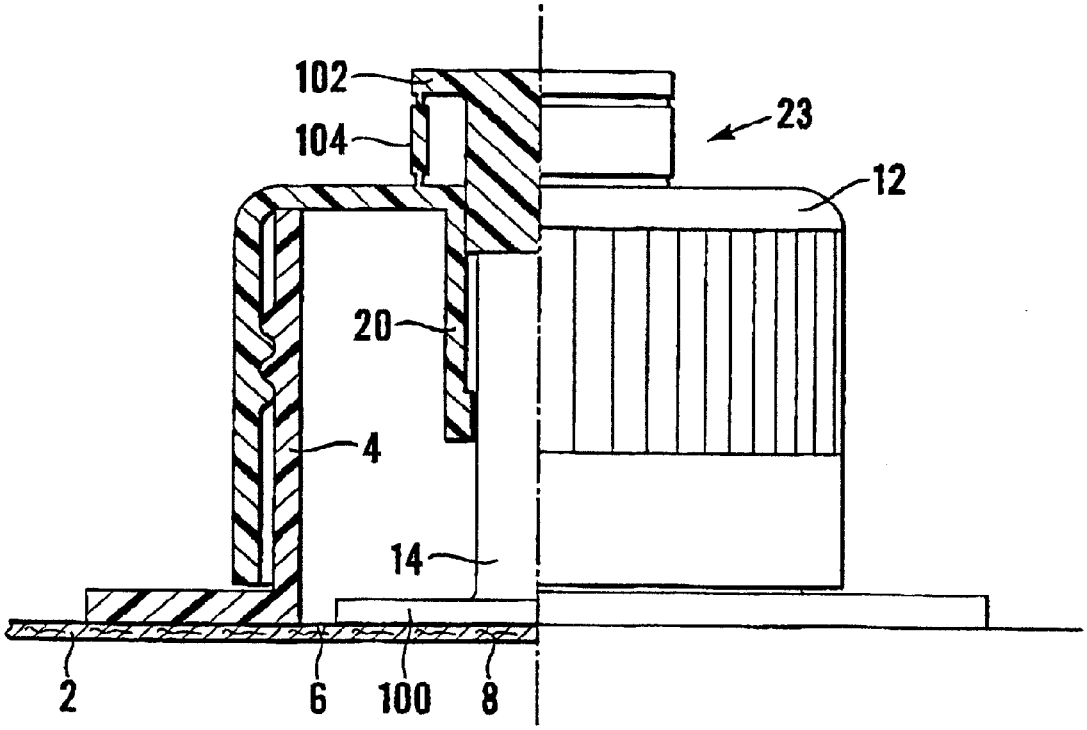
Figure 9:
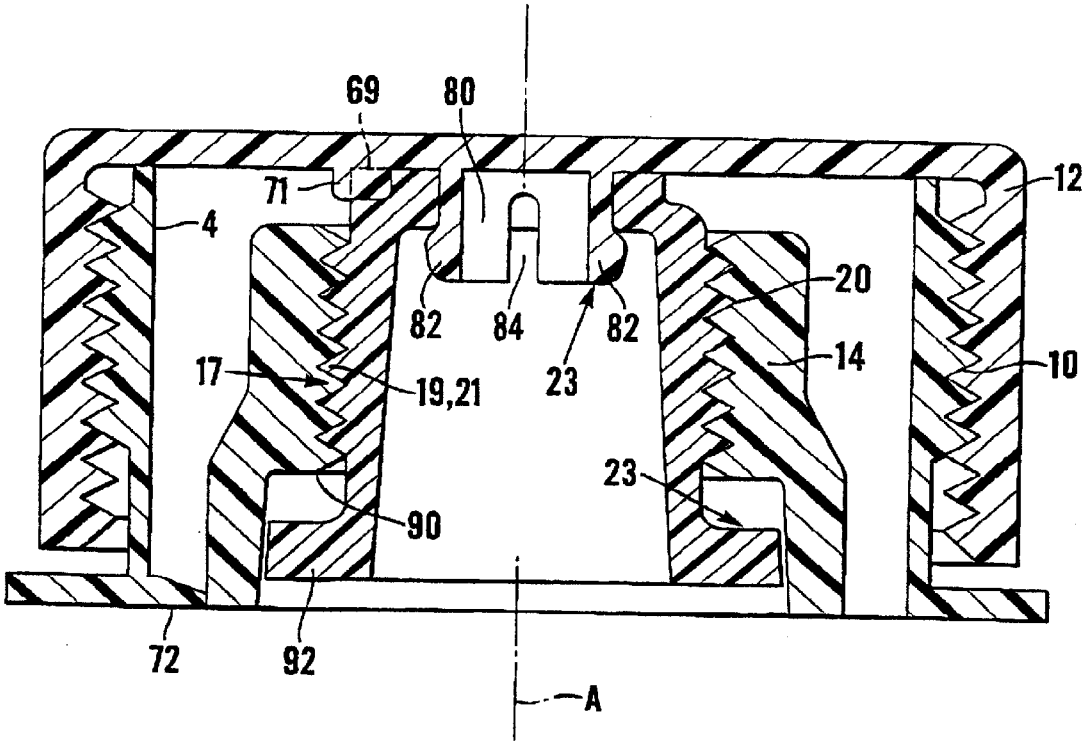

In order that the invention may be clearly and completely disclosed, reference will now be made, by way of example, to the accompanying drawings, in which:

FIG. 1 is a fragmentary sectional view through a plastics pour spout fitment welded to a wall of a packaging carton, the left-hand half of the Figure being on a diametral sectional plane and the right-half of the Figure being partly in side elevation and partly on that diametral sectional plane, FIG. 2 is largely a fragmentary sectional view on a diametral sectional plane of a modified version of the pour spout fitment welded to the carton wall, FIG. 3 is a view similar to FIG. 2 but of another modified version of the fitment, FIG. 4 is a fragmentary top plan view of a further modified version of the fitment welded to a wall of a packaging carton, FIG. 5 shows a section taken on the diametral plane V—V of FIG. 4, FIG. 6 is an exploded, underneath perspective view of the version of FIGS. 4 and 5, FIG. 7 is a face-on, outside view of a portion of the wall of the packaging carton, FIG. 8 is a partly sectional, underneath perspective view of a yet further embodiment of the fitment, FIG. 9 shows an axial section through a still further modified version of the fitment, and FIG. 10 is a view of a yet still further modiified version of the fitment attached to a wall of a packaging carton, the left-hand side of the Figure showing an axial section through the fitment and the right-hand side of the Figure being a side elevation thereof.

Referring to FIG. 1, packaging material 2 has attached thereto a pour spout fitment 3 including a pour spout 4 including at its inner end a radially outward flange 5 which is heat-and-pressure welded to the outside surface of the packaging material 2 immediately radially outward of an external, continuous, annulus of weakening 6 in the material 2. The annulus of weakening 6 defines a circular disc 8 of the packaging material. As shown more clearly in, for example, the version of FIGS. 5 to 7, the packaging material 2 consists of a laminate including inner and outer layers 2*a* and 2*b* of a substance, such as LDPE, which is a good barrier to moisture, and an intermediate layer 2*c* of paperboard The moisture barrier layers 2*a* and 2*b* may be extrusion-coated directly onto the inside and outside surfaces of the paperboard during the manufacture of the packaging material 2; however, the fitment 3 finds particular application to a packaging material in which there is, between the layers 2*a* and 2*c,* a layer 2*d,* which is a gas barrier layer, for example a layer of ethylene vinyl alcohol (EVOH) or aluminium foil. The layers 2*a,* 2*b* and 2*d* are tough relative to the paperboard 2*c*. By opening of the pour spout fitment, the disc 8 is removed to break the internal barrier layers 2*a* and 2*d* to provide a pouring opening. The pour spout 4 is provided with external threading 10 for a cap-shaped screw closure 12, which is preferably releasably fixed to the pour spout 4 by some tamper-evident device, for instance by means of an annular band 7 (shown in dotted lines). Inside the pour spout 4 is arranged co-axially a plunger 14, the inner end of which is secured to the layer 2*b* of the disc 8, simultaneously with securing of the flange 5 to the annular portion of the layer 2*b* located round the disc 8. Such securing is by glueing or welding, preferably by hot air and (then) pressure welding. The plunger 14 takes the form of a tube 18 which, towards its outer end, is provided with internal left-hand threading 19 co-operating with external left-hand threading 21 provided on a co-axial inner skirt 20 of the screw cap 12. The threading 19 and 21 provides a mechanism 17 which converts rotary motion of the cap 12 relative to the spout 4 into the linear inward displacement of the plunger 14. Integral with the plunger 14 and extending around the outer end thereof is a resilient ratchet arm 22, which is adapted to co-operate with an internal ratchet tooth 24 integral with the screw cap 12 and arranged on the inside of the screw cap immediately outwardly of the outer end of the plunger 14. The arm 22 and the tooth 24 provide a retaining device 23 which assists in retaining the plunger 14 upon the cap 12.

Before the pour spout fitment 3 as shown in FIG. 1 is attached to the packaging material 2, the plunger 14 can be screwed fully into the bottom of the fitment, using the threading 19,21, since the ratchet tooth 24 and the resilient ratchet arm 22 can easily ride over each other in the particular rotational sense in question. Then the fitment 3 can be attached to the packaging material 2, by heat-and pressure-welding of the flange 5 and the plunger 14 to the material 2. To open the carton, the screw cap 12 is unscrewed, so that the plunger 14, which is secured to the outside of the disc 8, will, owing to the left-handed threading 19,21 between the plunger 14 and the skirt 20, initially be displaced purely linearly inwards, to press the disc 8 inwards, until the ratchet tooth 24 abuts the free end of the arm 22, so that relative angular motion between the screw cap 12 and the plunger 14 is prevented. Continuous turning of the screw cap 12 thus forces the plunger 14 to follow, so that the initially inwardly pressed disc 8 will be wrenched free from the wall of the carton along the annulus of weakening 6, whereupon the disc 8 will be displaced outwardly with the plunger 14 so that, once the screw cap 3 and thus the plunger 14 have been completely removed, the disc 8 also is completely removed from within the pour spout 4, so providing in the carton wall a completely circular, pouring opening of a through-flow cross-sectional area substantially coincident with that of the pour spout 4. The intention behind having purely linearly axially inward movement of the plunger 14 before rotation thereof is to produce initially a compression of the paperboard layer 2*c* of the disc 8 so that, upon rotation of the plunger 14, there is an optimal transfer of turning forces from the plunger to the innermost barrier layer 2*a,* to try to ensure wrenching of the portion of the layer 2*a* in the disc 8 from the carton wall, without delaminating of the disc 8 through the paperboard, which would leave the pouring opening still closed by the layer 2*a* (and the layer 2*d*).

The version shown in FIG. 2 differs from that shown in FIG. 1 in that the screw threading 19,21 and the ratchet arrangement 22,24 are omitted and that the inner skirt 20 of the screw cap 12 is provided with external, radial, camming pins 28 engaging in obliquely inclined, closed-ended grooves 26 formed in the inner surface 15 of the plunger 14, the pins 28 and the grooves 26 providing the mechanism 17. Thus, upon unscrewing of the cap 12, the camming pins 28 press the plunger 14 purely linearly axially inwards until the camming pins 28 abut the outer ends of the grooves 26, whereupon the plunger 14 is forced to turn with the screw cap 12 so that, if the disc 8 has not already been broken away from the carton wall by the axially inward displacement of the plunger 14, it is wrenched away from the carton wall by the rotation of the plunger 14. Again, it remains attached to the plunger 14 and is removed therewith from the pour spout 4. Owing to the retaining device 23 provided by abutment between the pins 28 and the outer ends of the grooves 26, the plunger 14 remains connected to the cap 12.

The version shown in FIG. 3 differs from that shown in FIG. 2 in that the inner skirt 20 of the screw cap 12 is arranged radially outwards of the plunger 14 attached to the disc 8, and in that the plunger 14 has diametrically opposite, external, camming pins 32 engaged in obliquely inclined, closed-ended slots 34 through the skirt 20. Again, unscrewing of the cap 12 causes the plunger 14 initially to be displaced purely linearly axially inwards until the outer ends of the slot 34 come to abut the pins 32, whereupon the plunger 14 is forced to follow the turning of the cap 12, so detatching the disc 8 from the carton wall and removing it together with the cap 12 and the plunger 14.

The version shown in FIGS. 4 to 7 is similar in many respects to the version shown in FIG. 3. Referring to FIGS. 4 to 7, the screw cap 12 again co-operates with the pour spout 4 by way of threading 10 and has an inner skirt 20 co-axially encircling a plunger 14. The outer end of the plunger 14 includes two end camming surfaces 40 and 42 arranged at an angular pitch of 180° about the axis A of the fitment. Each of the camming surfaces 40 and 42 is of a radial width of at least one-quarter of the external diameter of the plunger 14, so as to give reliable operation in spite of manufacturing tolerances and any minor manufacturing defects. Each camming surface 40,42 terminates at its outer end in an abutment 44. Moulded in with the inner skirt 20 so as to project radially inwardly from the skirt are two obliquely inclined camming surfaces (of which one is seen and referenced 46) terminating at their inner ends in respective abutments (of which one is seen and referenced 48). Adjacent to its inner end the plunger 14 is formed externally with an annular, co-axial groove 50 which is engageable by a complementary rib 52 formed internally of the skirt 36 adjacent its inner end. The rib 52 is a snap-fit in the groove 50 and serves to retain the plunger 14 in its axially withdrawn condition in the skirt 20 shown in FIG. 5, in which condition it is heat-and-pressure welded to the layer 2*b* at the same time as is the flange 5. The camming surfaces (46) and the abutments (48) are also of a radial width substantially equal to that of the camming surfaces 40 and 42 and the abutments (44) and for the same reasons. The camming surfaces provide the mechanism 17.

Upon unscrewing of the cap 12, the camming surfaces and the abutments 40 to 48 co-operate, initially to press the plunger 14 purely linearly axially inwards, whereupon the groove 50 disengages from the rib 52, until the abutments (44 and 48) come into contact with each other, so that the plunger 14 is forced to turn with the cap 12, to detach the disc 8 from the carton wall if the disc has not already been detached by the linearly inward displacement of the plunger 14. The disc 8 is then removed with the plunger 14 and the cap 12. The plunger 14 is prevented from leaving the skirt 20 by engagement of the rib 52 against a shoulder 54 part-way along the external surface of the plunger 14. The rib 52 and the shoulder 54 provide the retaining device 23.

The pour spout 4, the cap 12 and the plunger 14 are so designed that they can be assembled to the relative conditions shown in FIG. 5 by simply forcing the pour spout 4 and the plunger 14 axially into the cap 12.

In order to prevent the ring of weakening 6 from being at least partly severed during heat-and pressure-sealing of the fitment 3 to the material 2, the weakening 6 may advantageously not be an annular partial-depth cut, but may be a series of arcuate, partial-depth cuts 6*a* arranged end-to-end and spaced apart from each other by non-cut bridges 6*b*.

The version shown in FIG. 8 differs quite considerably from any of the previous versions. It again includes a screw cap 12 screwed onto a pour spout 4, but in this version the plunger 14 takes the form of a ring 60 which is connected by curved links, in this example three curved links 62, to an outer ring 64 attached by any appropriate retaining device 23, for example by catches 66 shown, to the inside surface of the outer end of the cap 12. The links 62, which provide the mechanism 17 and are of a helically curved form substantially co-axial with the spout 4 have their inner ends connected by integrally moulded hinges 68 to the ring 60 and their upper ends connected by integrally moulded hinges 70 to the ring 64. At the positions of the hinges 70, there are integral with the ring 64 respective ratchet teeth 69 which co-operate with an equal number of ratchet teeth 71 at the inside of, and integral with, the cap 12 to allow screwing of the cap 12 onto the spout 4 and thus relative to the ring 64 but preventing more than a small degree of turning of the cap 12 relative to the ring 64 in the unscrewing sense. The ring 60 is integrally moulded with the pour spout 4 by way of frangible bridges 72 which serve to retain the ring 60 in an axial position ready for heat-and pressure-sealing to the packaging material.

With the fitment 3 of FIG. 8 adhered to the carton wall, unscrewing of the cap 12 causes the outer ring 64 to rotate relative to the inner ring 60 to bring the links 62 from their conditions shown in which they are relatively oblique to the axis of the fitment, into positions in which they are increasingly less oblique and so force the ring 60 purely linearly axially inwards to commence fracturing of the weakening 6. Continued turning of the cap 12 then brings the links 62 from those conditions in which they are in compression to conditions in which they are in tension and thus pulls the ring 60 axially outwards and turns the ring 60 to wrench the disc 8 free from the carton wall. Again, the disc is removed from the pour spout 4 together with the ring 60.

The version shown in FIG. 9 is, in effect, a combination of the versions of FIGS. 1 and 8. In this version, the screw cap 12 is formed internally with a central boss 80 which provides the catches 66 through having externally at its inner end a rib 82 interrupted by slots 84 to allow a non-integral skirt 20 to be snap-fitted over and retained on the boss 80. The skirt 20 is provided with the ratchet teeth 69 to co-operate with the ratchet teeth 71 of the cap 12. The skirt 20 is encircled by a plunger 14 which has an internal shoulder 90 and is connected to the skirt 20 by way of the threading 19,21, and integrally connected to the pour spout 4 by way of the bridges 72. At its inner end, the skirt 20 is formed with a radially outwardly directed annular flange 92. Upon unscrewing of the cap 12, the effect of the threading 19,21 is to push the plunger 14 purely linearly axially inwards until the shoulder 90 abuts the flange 92, whereupon the plunger 14 is forced to rotate with the skirt 20 and the cap 12. The axially inward movement of the plunger 14 of course breaks the bridges 72 and detaches the disc from the carton wall. Once the cap 12 is free from the pour spout 4, it can be removed together with the skirt 20, the plunger 14 and the disc.

The version shown in FIG. 10 differs significantly from any of the previous versions, in that the purely linearly axially inward displacement of the plunger 14 is not produced by unscrewing of the screw cap 12, but by axially inward manual pressure on the outer end of the plunger 14. The plunger 14 is in the form of a rod having radial flanges 100 and 102 at the inner and outer ends thereof. The flange 100 is adhered face-to-face to the disc 8, whilst the flange 102 is located axially outwards of the cap 12 with which it is integral via a tamper-evident tear band 104. The cap 12 includes an inner skirt 20 in which the rod-form part of the plunger 14 is a sliding fit. To open the carton, the band 104 is torn away, manual pressure is applied axially inwards to the outer end of the plunger 14 to detach the disc 8 from the carton wall, the axially inward movement of the plunger 14 relative to the cap 12 being limited by a retaining device 23 in the form of abutment of the flange 102 against the outside of the cap 12, and then the cap is unscrewed and removed from the pour spout 4, taking with it the plunger 14 and the disc 8.

Although examples of the invention have been described with reference to plastics-coated paperboard cartons, it is applicable to a variety of other packaging fields, particularly to other aseptic packaging fields. For example, the invention is also applicable to glass or plastics bottles, where the spout opening of the bottle is covered and sealed by means of a disc of plastics or metal foil. The packaging fields are not only those in which drinkable foods, such as milk, fruit juice and wine are packaged, particularly aseptically, but also to packaging fields in which other products, for example pharmaceutical products, are packaged.

We claim:

1. A pour spout fitment, comprising a pour spout having a longitudinal axis and adapted to be attached to packaging material, and a plunger in said pour spout and displaceable inwards along said axis relative to said pour spout to displace inwards a portion of said packaging material closing an inner end of the pour spout, an inner end of said plunger being adapted to be attached to an outer surface of said portion of said packaging material by one of glueing and welding, and the arrangement being such that, following the inward displacement of the plunger, the plunger and thus said portion are displaceable outwards along said axis relative to said pour spout to beyond said pour spout.

2. A fitment according to claim 1, and further comprising a cap closing an outer end of said pour spout and rotatable about said axis relative to said pour spout for removing said cap from said pour spout to open said outer end, a mechanism between said cap and said plunger adapted to convert rotary motion of said cap relative to said pour spout into linear inward displacement of said plunger, and retaining means effective between said cap and said plunger to retain said plunger upon said cap during the outward displacement of said plunger together with said cap, said plunger being turnable about said axis relative to said cap to a limited extent in each direction of turning.

3. A fitment according to claim 2, wherein said cap has a tubular inward projection which opens axially inwardly of said pour spout and which internally receives said plunger.

4. A fitment according to claim 2, wherein said mechanism comprises a pin-in-slot mechanism.

5. A fitment according to claim 4, wherein said retaining means comprises an inner end boundary of said slot for abutting said pin.

6. A fitment according to claim 3, wherein said mechanism comprises a camming face around the inside of said projection and a co-operating camming face around the outer end of said plunger.

7. A fitment according to claim 2, wherein said cap has a tubular inward projection which opens axially inwardly of said pour spout and which receives said plunger, and wherein said mechanism comprises a camming face around said projection and a co-operating camming face around the outer end of said plunger, the width of at least the latter of the two camming faces being at least equal to substantially one-quarter of the width of said plunger.

8. A fitment according to claim 2, wherein said retaining means comprises respective shoulders on said cap and on said plunger.

9. A fitment according to claim 2, wherein said plunger comprises a ring which is connected to said cap by way of said mechanism in the form of links which are attached to said ring at respective locations distributed around said ring and extend obliquely peripherally towards said cap to which said links are attached at respective locations distributed around an end wall of said cap, said cap being turnable about said axis relative to the ring to reduce the peripheral obliquity of the links and thus produce the inward displacement of the ring.

10. A fitment according to claim 9, wherein said links are of a helically curved form substantially co-axial with said pour spout.

11. A fitment according to claim 2, wherein said cap has a tubular inward projection substantially co-axial with said pour spout, and said plunger is connected to said projection by way of threading of which said mechanism is comprised, said plunger being turnable relative to said projection to a limited extent in each direction of turning.

12. A fitment according to claim 2, wherein said cap has an inward projection substantially co-axial with said pour spout, and said mechanism comprises respective screwthreadings on said projection and said plunger substantially co-axial with said spout and co-operating with each other.

13. In combination, packaging material, and a pour spout fitment, comprising a pour spout having a longitudinal axis and attached to said packaging material, and a plunger in said pour spout and displaceable inwards along said axis relative to said pour spout to displace inwards a portion of said packaging material closing an inner end of the pour spout, an inner end of said plunger being attached to an outer surface of said portion of said packaging material by one of glueing and welding, and the arrangement being such that, following the inward displacement of the plunger, the plunger and thus said portion are displaceable outwards along said axis relative to said pour spout to beyond said pour spout.

14. A combination according to claim 13, wherein said fitment further comprises a cap closing an outer end of said pour spout and rotatable about said axis relative to said pour spout for removing said cap from said pour spout to open said outer end, a mechanism between said cap and said plunger adapted to convert rotary motion of said cap relative to said pour spout into linear inward displacement of said plunger, and retaining means effective between said cap and said plunger to retain said plunger upon said cap during the outward displacement of said plunger together with said cap, said cap being turnable about said axis relative to said plunger to a limited extent in each direction of turning.

15. A combination according to claim 14, wherein said cap has a tubular inward projection which opens axially inwardly of said pour spout and which internally receives said plunger.

16. A combination according to claim 14, wherein said mechanism comprises a pin-in-slot mechanism.

17. A combination according to claim 16, wherein said retaining means comprises an inner end boundary of said slot for abutting said pin.

18. A combination according to claim 15, wherein said mechanism comprises a camming face around the inside of said projection and a co-operating camming face around the outer end of said plunger.

19. A combination according to claim 14, wherein said cap has a tubular inward projection which opens axially inwardly of said pour spout and which receives said plunger, and wherein said mechanism comprises a camming face around said projection and a co-operating camming face around the outer end of said plunger, the width of at least the latter of the two camming faces being at least equal to substantially one-quarter of the width of said plunger.

20. A combination according to claim 14, wherein said retaining means comprises respective shoulders on said cap and on said projection.

21. A combination according to claim 14, wherein said plunger comprises a ring which is connected to said cap by way of said mechanism in the form of links which are attached to said ring at respective locations distributed around said ring and extend obliquely peripherally towards said cap to which said links are attached at respective locations distributed around an end wall of said cap, said cap being turnable about said axis relative to the ring to reduce the peripheral obliquity of the links and thus produce the inward displacement of the ring.

22. A combination according to claim 21, wherein said links are of a helically curved form substantially co-axial with said pour spout.

23. A combination according to claim 14, wherein said cap has a tubular inward projection substantially co-axial with said pour spout, and said plunger is connected to said projection by way of threading of which said mechanism is comprised, said plunger being turnable relative to said projection to a limited extent in each direction of turning.

24. A combination according to claim 14, wherein said cap has an inward projection substantially co-axial with said pour spout, and said mechanism comprises respective screwthreadings on said projection and said plunger substantially co-axial with said spout and co-operating with each other.

25. A combination according to claim 13, wherein said packaging material and said portion thereof comprise inner and outer surface layers of thermoplastics and a layer of paperboard intermediate said inner and outer surface layers.

26. A combination according to claim 25, wherein said material and said portion thereof further comprise a gas barrier layer intermediate the paperboard layer and the inner surface layer of thermoplastics.

27. A combination according to claim 13, wherein said portion is encircled by a ring of weakness in said material.

28. A combination according to claim 27, wherein said ring of weakness has been formed by cutting through part of the thickness of said material from the outer surface of said material.

29. A combination according to claim 28, wherein said ring of weakness comprises a plurality of cuts arranged end-to-end and spaced apart from each other.

30. A method comprising forming a ring of weakness around a portion of packaging material, attaching to said packaging material a pour spout of a pour spout fitment so that said pour spout extends around said portion, said pour spout having a longitudinal axis, and attaching to the outer surface of said portion, by one of glueing and welding, a plunger of said pour spout fitment.

31. A method according to claim 30, wherein said forming comprises cutting through part of the thickness of said material from the outer surface of said material.

32. A method according to claim 30, wherein said packaging material and said portion thereof comprise inner and outer surface layers of thermoplastics and a layer of paperboard intermediate said inner and outer surface layers.

33. A method according to claim 32, wherein said material and said portion thereof further comprise a gas barrier layer intermediate the paperboard layer and the inner surface layer of thermoplastics.

34. A method comprising providing packaging material to which is attached a pour spout fitment, with a plunger of said fitment being attached, by one of glueing and welding, to an outer surface of a portion of said material and a pour spout of said fitment being attached to portions of said material around said portion, detaching said portion from said portions by a procedure comprised or displacing said plunger inwardly along an axis of said fitment to cause said plunger to press against said portion, and withdrawing said plunger and thus said portion outwardly from said pour spout.

35. A method according to claim 34, wherein said displacing of said plunger inwardly along said axis is a purely linear displacement of said plunger.

36. A method according to claim 35, wherein said procedure includes, after said displacing, rotating said plunger round said axis.

* * * * *